United States Patent [19]

Vogelsberg

[11] 4,196,576

[45] Apr. 8, 1980

[54] METHOD AND APPARATUS FOR S-Z TWISTING OF ELECTRICAL CABLES

[75] Inventor: Dieter Vogelsberg, Coburg, Fed. Rep. of Germany

[73] Assignee: Siemens Aktiengesellschaft, Berlin and Munich, Fed. Rep. of Germany

[21] Appl. No.: 912,984

[22] Filed: Jun. 6, 1978

[30] Foreign Application Priority Data

Jun. 8, 1977 [DE] Fed. Rep. of Germany ..... 2726172

[51] Int. Cl.[2] ..... H01B 13/04

[52] U.S. Cl. ..... 57/294; 57/293

[58] Field of Search ..... 57/34 AT, 90, 91, 156, 57/293, 294

[56] References Cited

U.S. PATENT DOCUMENTS

| | | | |
|---|---|---|---|
| 3,481,127 | 12/1969 | Vogelsberg | 57/34 AT |
| 3,491,525 | 1/1970 | Sugi | 57/34 AT |
| 3,593,509 | 7/1971 | Feese et al. | 57/34 AT |
| 3,782,092 | 1/1974 | Vogelsberg | 57/34 AT |
| 3,823,536 | 7/1974 | Vogelsberg et al. | 57/34 AT |
| 3,884,024 | 5/1975 | Oestreich et al. | 57/34 AT |
| 4,056,925 | 11/1977 | Vogelsberg | 57/34 AT |

FOREIGN PATENT DOCUMENTS

| | | | |
|---|---|---|---|
| 2458353 | 6/1976 | Fed. Rep. of Germany | 57/34 AT |

*Primary Examiner*—John Petrakes

*Attorney, Agent, or Firm*—Kenyon & Kenyon

[57] ABSTRACT

In order to avoid troublesome length differences between the core and the outer layer in the S-Z twisting of five or more elements to be twisted, the average value of the input twist is chosen equal to the average value of the resulting S and Z twist.

8 Claims, 4 Drawing Figures

METHOD AND APPARATUS FOR S-Z TWISTING OF ELECTRICAL CABLES

BACKGROUND OF THE INVENTION

This invention relates to the SZ twisting of elements such as wires or the like in general and more particularly to an improved method and apparatus for avoiding length differences when twisting a large number of elements.

The development in the field of SZ twisting technology for electrical cables and wires, which started at the beginning of the Sixties, has led to SZ twisting processes and SZ twisting machines by means of which two to five elements to be twisted, for instance, conductors for light PVC-sheathed cables, conductors for pairs, triplets or spiral quads of communication cables, or spiral quads for base bundles of communication cables can be twisted together without problem. A characteristic of all developed SZ twisting methods working with a concentrated or unconcentrated longitudinal accumulator is that the final twist of the stranded material results from a superposition of at least two oppositely directed twisting processes which take place at the input and output of the SZ twisting machine. This applies, for instance, to twisting with a rotating longitudinal accumulator of alternating direction of rotation (U.S. Pat. No. 3,169,360), to twisting with a revolving twisting device and changing accumulator content (U.S. Pat. Nos. 3,481,127; 3,797,217), to twisting by means of a twisting head (twisting closer) arranged at the end of a torsion section (U.S. Pat. No. 3,593,509) as well as to twisting with two twisting heads which are arranged at the beginning and end of a torsion section and revolve with constant direction of rotation (U.S. Pat. No. 3,823,536).

In the SZ twisting of five or more elements, difficulties can arise due to the fact that the elements to be twisted are arranged in one or more layers about a core in the finished stranded unit since then the absolute length of the elements to be twisted in the layer or layers is greater than the length of the twisted elements arranged in the core. Under the influence of the twisting operations executed one after the other during the SZ twisting, this leads to relative length differences between the core and the outer layer to the twisted material, which can result in serious disturbances in the twisting process. If, for instance, a shorter length of lay is produced in the last twisting operation than in the first twisting operation, then the core of the strand is upset and has a tendency to emerge to the outside between the elements of the outer layer.

SUMMARY OF THE INVENTION

Starting out from this insight, it is an object of the present invention to improve the known SZ twisting methods and machines which work with constant running speed of the material to be twisted through the twisting device containing a concentrated or unconcentrated longitudinal accumulator, in such a manner that five or more elements can thereby also be twisted without trouble.

To solve this problem, the present invention therefore starts out from a method for twisting elements of electrical conductors or electrical cables to form a stranded unit with a twist direction alternating at intervals in which elements to be twisted, which run off from stationary supplies with constant velocity, run continuously through an SZ twisting equipment and leave the SZ twisting equipment with constant velocity, are twisted a first time when entering the SZ twisting equipment, and in which the superposition of the twists obtained in the SZ twisting equipment leads to a resultant twist with a twist direction alternating at intervals. According to the present invention, the amount of twist executed when the elements to be twisted run into the SZ twisting equipment, or its average value, is to be equal or approximately equal to the average values of the amounts of the resulting S and Z twist of the stranded unit or the average value of the amounts of the average resulting S and Z twist.

The amount of twist executed when entering, or its average value, is "approximately equal" if it is between 0.75 and 1.5 times the average value of the amounts of the resultant S and Z twist of the stranded unit or the average value of the amount of the mean S and Z twist.

In an SZ twisting method designed in this manner, as many twist lays per SZ distance are produced during the first twisting operation as are present per SZ distance in the finished stranded unit. As a result, the lengths of elements to be twisted which are needed in the finished twisted unit according to the design specification are pulled off the suppliers, exactly or approximately, and run into the SZ twisting equipment. Adding up of undesired length differences in the finished stranded unit is thereby prevented completely or partly.

With the new twisting method it is not necessary for the amount of twist executed at the input of the SZ twisting equipment to correspond exactly to the final twist of the twisted material. Since different sections of the twisted material are twisted further or retwisted anyhow, it is sufficient if the number of twist lays, averaged over an SZ period, agrees after entering the SZ twisting equipment and after leaving it. Length differences from one S-section to the subsequent Z-section are relatively easily equalized under the influence of unavoidable tensile stresses, especially if the material to be twisted is conducted freely through the air within the SZ twisting equipment or before it enters the following manufacturing facility. In any case, however, the detrimental adding up of length differences over the entire production length is prevented.

The measure provided under the present invention can have a positive effect even for twisting as few as five elements, for instance, when twisting five conductors to form the core of a light PVC-sheathed cable, and also when twisting five spiral quads to form a base bundle. However, it is of special advantage when twisting more than five elements, where in each case one or more twisted elements are arranged in the core and the remaining twisted elements in one or more layers. This is the case, for instance, in twisting conductors for control cables, in twisting conductor pairs to form base bundles, in twisting base bundles to form main bundles and in twisting wires to form stranded wire, conductors or conductor rope.

The practical embodiment of the measure provided within the scope of the present invention depends on the SZ twisting technique chosen in each case. For twisting methods, in which the elements are twisted in the SZ twisting equipment one or more time with a direction of rotation changing at intervals, i.e., for instance, in SZ-twisting by means of a longitudinal accumulator of alternating direction of rotation or by means of a twisting device, the storage content of which is alternatingly increased or decreased, it is advantageous to keep the direction and the amount of twist executed, when the elements to be twisted enter the SZ twisting equipment, constant. In twisting methods, in which the elements to be twisted run through the SZ twisting equipment in stretched condition and, when entering the SZ twisting equipment, are also twisted with the same direction and, when leaving the SZ twisting equipment, with also constant but opposite direction, and in which the amount of twist is changed at intervals, for instance, by using an SZ twisting equipment which consists of two twisting heads with constant direction of rotation but changing speed of rotation, the amount of the twist is changed advantageously at a ratio which is between 1:2 and 1:5 but preferably 1:3. In that case, the average input twist is equal or approximately equal to the amount of the resulting SZ twist.

The new method is advantageously carried out by means of known SZ-twisting machines, in which the twisting device is limited by two twisting closers or twisting points, between which the twisting device proper, which consists of one or more twisting heads or of two twisting heads forming a stretched out accumulator or of one or several concentrated accumulators constructed from groups of pulleys is arranged. In accordance with a further embodiment of the present invention, a constantly rotating twisting head which grips the elements to be twisted from the outside with a friction force, is arranged between the first twisting closer or twisting point and the twisting device proper, or ahead of this twisting closer or twisting point. This twisting head then rotates with a speed which corresponds to the resulting SZ twist of the twisted material.

DETAILED DESCRIPTION OF THE INVENTION

Figure 1:
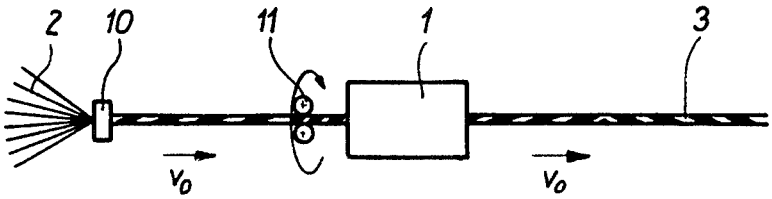
In FIGS. 1 to 4, schematically illustrate SZ twisting apparatus by which the SZ twisting method according to the present invention can be practiced.

FIG. 1 shows an SZ twisting apparatus 1, by means of which eight (insulated) conductors 2 can be twisted to form a stranded unit 3 with a twist direction changing at intervals. The elements to be twisted run off from stationary supply devices, not shown, with constant velocity and run through the SZ twisting equipment 1, likewise with constant velocity $v_o$. Ahead of the SZ twisting equipment 1, a twisting head 11, which rotates with constant speed and direction of rotation and which is preceded by a twisting closer 10, i.e., a first twisting point, is arranged. The speed of rotation of this twisting head 11 is chosen so that the twist resulting from the speed of rotation and the constant pull-off velocity of the twisted elements in the region between the twisting closer 10 and the twisting head 11 is equal to the average of the resulting SZ twist; if it is assumed that the SZ-twisted strand 3 has the twists $+d_1$ and $-d_2$, the twist of the strand in the region between the twisting closer 10 and the twisting head 11 is therefore $(d_1+d_2)/2$.

Figure 2:
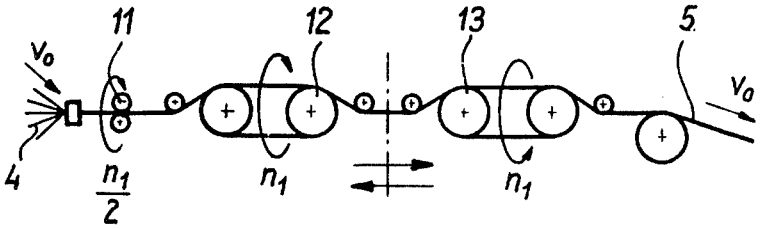

In the embodiment shown in FIG. 2, five spiral quads 4 are twisted to a base bundle 5 by means of two concentrated longitudinal accumulators 12 and 13, the storage contents of which are alternatingly increased and decreased corresponding to each other and which revolve with constant speed of rotation $n_1$ but with opposite direction of rotation. With constant entrance velocity $v_o$ of the spiral quads 4 into the twisting device and with constant exit velocity of the twisted material from the twisting device, the speed of rotation of the twisting head 11 arranged between the concentrated longitudinal accumulator 12 and the twisting closer 14 is chosen equal to one-half the speed of rotation of the rotating accumulators 12 and 13. As a result, the amount of twist obtained when entering the twisting closer 14 is equal to the amount of the resulting S and Z twist.

Figure 3:
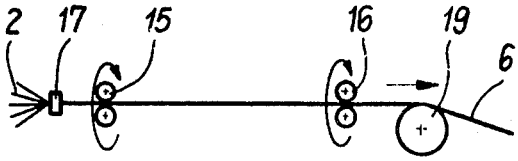

In the embodiment shown in FIG. 3, the SZ twisting equipment with which five conductors 2 are twisted to a conductor core 6, consists of the twisting closer 17, a deflection roll 19 and the two twisting heads 15 and 16 arranged in between. The twisting heads revolve with constant direction of rotation but with synchronously changing speed of rotation. The two speed steps are chosen so that the speeds of rotation are in the ratio of 1:3. The speeds of the twisting heads 15 and 16 may differ from each other.

Figure 4:
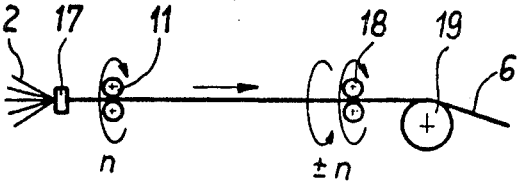

In the embodiment shown in FIG. 4, the five conductors 2 are twisted to a conductor core 6 by means of the twisting head 18 which is arranged at the end of a torsion section limited by the twisting closer 17 and the deflection roll 19. The twisting head 18 revolves with a direction of rotation changing at intervals. At the beginning of the twisting section, a twisting head 11 is arranged which revolves with constant direction of rotation, and the speed of rotation n of which corresponds to the speed of the twisting head 18. Instead of using the twisting head 11, the rotary motion of the twisting head 18 can also be chosen so that the speed steps are matched to each other in line with the present invention while the direction of rotation remains the same.

What I claim is:

1. In a method for twisting elements to be twisted of electrical conductors or electrical cables to form a stranded unit with a twist direction changing at intervals, in which the elements to be twisted, which run off from stationary supplies with constant velocity, run through an SZ twisting equipment continuously and leave the SZ twisting equipment with constant velocity, are twisted a first time when entering the SZ twisting equipment and are twisted at least a second time when leaving the SZ twisting equipment, and in which the superposition of the twists obtained in the SZ twisting equipment leads to a resulting twist with a twist direction changing at intervals, the improvement comprising making the amount of twist executed when the elements to be twisted enter the SZ twisting equipment or its average value, equal or approximately equal to the average value of the amount of the resulting S and Z twist of the stranded unit or the average value of the amounts of the resulting average S and Z twist.

2. The method according to claim 1, in which the elements to be twisted are twisted in the SZ twisting equipment once or several times with a direction changing at intervals, wherein the improvement further comprises holding the direction and amount of the twist executed, when the elements to be twisted enter the SZ twisting equipment, constant.

3. The method according to claim 1, in which the elements to be twisted run through the SZ twisting equipment in stretched condition and are twisted with constant direction when entering the SZ twisting equipment and are twisted also with constant, but opposite direction when leaving the SZ twisting equipment, and in which the magnitude of the twisting is changed at intervals, wherein the improvement further comprises changing the magnitude of the twisting in a ratio of between 1:2 and 1:5.

4. The method of claim 3 wherein said magnitude is changed in a ratio of about 1:3.

5. The method according claim 1 including twisting more than five elements to be twisted, especially twisting conductors for control cables, twisting pairs of conductors to form base bundles, twisting base bundles into main bundles and twisting wires into stranded wire or conductor rope.

6. In apparatus for twisting elements to be twisted of electric conductors or electric cables to form a stranded unit with a twist direction changing at intervals which includes; stationary supplies for the elements to be twisted; SZ twisting equipment including a first twisting point, a second twisting point and means disposed therebetween and cooperating with said first and second twisting points for twisting said elements a first time when entering said equipment and a second time when leaving said equipment in such a manner that the superpositions of the twists obtain therein leads to a resulting twist with a twist direction changing at intervals, said means cooperating with said twisting points including at least a first twisting head; and means for drawing said elements off said stationary supplies and causing them to run through said SZ twisting equipment continuously such that they enter and leave said SZ twisting equipment with a constant velocity, the improvement comprising an additional twisting head which grips the elements to be twisted from the outside with a friction force, rotating with a constant speed and direction, disposed before said means for twisting, the rotational speed of said additional twisting head being such that it imparts a twist to said elements to be twisted which is equal to the average of the resulting SZ twist imparted by said twisting device.

7. The improvement according to claim 6 wherein said twisting head is disposed between the first twisting point and said twisting device.

8. The improvement according to claim 6 wherein said twisting head is disposed ahead of said first twisting point.

* * * * *